US008339346B2

(12) United States Patent
Li et al.

(10) Patent No.: US 8,339,346 B2
(45) Date of Patent: Dec. 25, 2012

(54) DISPLAY PANEL DRIVING VOLTAGE SUPPLY APPARATUS AND METHOD

(75) Inventors: Hung-chun Li, Shulin (TW); Mu-shan Liao, Xizhou Township (TW); Tung-hsin Lan, Taipei (TW)

(73) Assignee: Chunghwa Picture Tubes, Ltd., Bade, Taoyuan (TW)

( * ) Notice: Subject to any disclaimer, the term of this patent is extended or adjusted under 35 U.S.C. 154(b) by 255 days.

(21) Appl. No.: 12/953,409

(22) Filed: Nov. 23, 2010

(65) Prior Publication Data

US 2012/0081038 A1 Apr. 5, 2012

(30) Foreign Application Priority Data

Sep. 30, 2010 (TW) ..... 99133349 A

(51) Int. Cl.
*G09G 3/36* (2006.01)

(52) U.S. Cl. ..... 345/92; 345/82; 345/204; 345/212; 345/102

(58) Field of Classification Search ..... 345/92, 345/98–100, 76–84, 102, 204, 211–214
See application file for complete search history.

(56) References Cited

U.S. PATENT DOCUMENTS

2008/0036725 A1 2/2008 Lee et al.
2010/0085348 A1 4/2010 Bae et al.

FOREIGN PATENT DOCUMENTS

CN 101587700 A 11/2009
CN 101794557 A 8/2010

*Primary Examiner* — Tuyet Thi Vo
(74) *Attorney, Agent, or Firm* — Cheng-Ju Chiang

(57) ABSTRACT

A display panel driving voltage supply apparatus and method is disclosed. Said supply apparatus comprises: a timing controller for providing a voltage control signal and a switch control signal; a level shifter, receiving the voltage control signal for selecting a first specified voltage to be transmitted on a first driving voltage supply line as well as selecting a second specified voltage to be transmitted on a second driving voltage supply line according to the voltage control signal; and a first switch, wherein the first and the second driving voltage supply lines are electrically connected with each other to charge share between the first and the second specified voltages when the first switch is turned on under the control of the switch control signal. Said supply apparatus is capable of solving the problem of high power consumption and thereby reducing the electricity consumption.

6 Claims, 7 Drawing Sheets

DISPLAY PANEL DRIVING VOLTAGE SUPPLY APPARATUS AND METHOD

TECHNICAL FIELD OF THE INVENTION

The present invention relates to a display panel driving voltage supply apparatus and method, and more particularly, to a display panel driving voltage supply apparatus and method capable of conducting charge sharing between driving voltages.

BACKGROUND OF THE INVENTION

Nowadays flat display technology has been widely applied to various types of display panels and products, such as liquid crystal display devices, mobile phones, and media players. As manufacturing processes are improved, gate driving circuits can be manufactured on an array substrate of the display panel for now. This is called a "gate on array" (GOA) technology and is supplanting the traditional manufacturing and packaging process of gate driving ICs; also it is capable of reducing the manufacturing cost and additional costs of materials and/or components.

FIG. 1 is a schematic diagram showing a conventional display panel driving voltage supply apparatus 10 for providing a display panel 1 with a driving voltage. The display panel 1 has a plurality of gate driving circuits, such as 151, 152, which are disposed thereon. The conventional display panel driving voltage supply apparatus 10 comprises a timing controller (T-CON) 12, a level shifter 14, and a first driving voltage supply line 101 and a second driving voltage supply line 102 coupled to the level shifter 14. The timing controller 12 outputs voltage control signals (e.g. CKV, CKVB) to the level shifter 14. The level shifter 14 has two terminals being inputted respectively with a first specified voltage and a second specified voltage such as 27V and −13V.

In the conventional display panel driving voltage supply apparatus 10, the level shifter 14 selects the first specified voltage to be transmitted on the first driving voltage supply line 101 and selects the second specified voltage to be transmitted on the second driving voltage supply line 102 according to the voltage control signals. For example, the level shifter 14 selects to output the first specified voltage 27V when the voltage control signal is at a high voltage level, and the level shifter 14 selects to output the second specified voltage −13V when the voltage control signals is at a low voltage level. Moreover, when the voltage control signal CKV is at the high voltage level, the voltage control signal CKVB will be at the low voltage level. Conversely, when the voltage control signal CKV is at the low voltage level, the voltage control signal CKVB will be at the high voltage level. Therefore, a first voltage supply signal CKV1 on the first driving voltage supply line 101 has a voltage variation of 40V. A second voltage supply signal CKVB1 on the second driving voltage supply line 102 also has a voltage variation of 40V.

As shown in FIG. 1, the first voltage supply signal CKV1 and the second voltage supply signal CKVB1 on the two driving voltage supply lines 201, 202, provide voltages to the respective gate driving circuits, e.g. 151, 152, so that the gate driving circuits output scan signals Gout1, Gout2, to the scan lines or gate lines on the display panel 1.

Since the voltage of the first voltage supply signal CKV1 on the first driving voltage supply line 101 is varied from −13V to 27V, and the voltage of the second voltage supply signal CKVB1 on the second driving voltage supply line 102 is varied from 27V to −13V for the same period of time, the operational voltage difference is spanned about 40V. In the conventional display panel driving voltage supply apparatus 10, the power consumption is too high and electricity is heavily consumed. This does not meet the requirements of designing environmental green products.

Therefore, how to solve the problem of high power consumption of the conventional display panel driving voltage supply apparatus and reduce the electricity consumption are important issues in this technical field.

SUMMARY OF THE INVENTION

The objective of the present invention is to provide a display panel driving voltage supply apparatus and method for solving the problem of high power consumption of the driving voltage supply apparatus and thereby reducing the consumption of electricity.

According to the above objective, the present invention provides a display panel driving voltage supply apparatus for providing a display panel with a driving voltage. The display panel driving voltage supply apparatus comprises: a timing controller for providing a voltage control signal and a switch control signal; a first driving voltage supply line; a second driving voltage supply line; a level shifter coupled to the first driving voltage supply line and the second driving voltage supply line respectively, the level shifter receiving the voltage control signal provided by the timing controller, and selecting a first specified voltage to be transmitted on the first driving voltage supply line as well as selecting a second specified voltage to be transmitted on the second driving voltage supply line according to the voltage control signal; and a first switch coupled between the first driving voltage supply line and the second driving voltage supply line, the first switch being controlled by the switch control signal provided by the timing controller to be turned on or off, wherein the first driving voltage supply line and the second driving voltage supply line are electrically connected with each other to charge share between the first specified voltage and the second specified voltage when the first switch is turned on.

In another aspect, the present invention provides a display panel driving voltage supply method for providing a display panel with a driving voltage. The display panel driving voltage supply method comprises steps of: providing a voltage control signal and a switch control signal; selecting a first specified voltage to be transmitted on a first driving voltage supply line and selecting a second specified voltage to be transmitted on a second driving voltage supply line according to the voltage control signal; and controlling the first driving voltage supply line and the second driving voltage supply line to be electrically connected or disconnected according to the switch control signal, wherein charge sharing is conducted between the first specified voltage and the second specified voltage when the first driving voltage supply line and the second driving voltage supply line are electrically connected with each other.

Since charge sharing is conducted between the voltages on the two driving voltage supply lines, the power supplied to the gate driving circuits can be reduced. Therefore, the present invention can solve the problem of high power consumption of the display panel driving voltage supply apparatus.

BRIEF DESCRIPTION OF THE DRAWINGS

The present invention will be described in details in conjunction with the appending drawings.

DETAILED DESCRIPTION OF THE INVENTION

Figure 1:
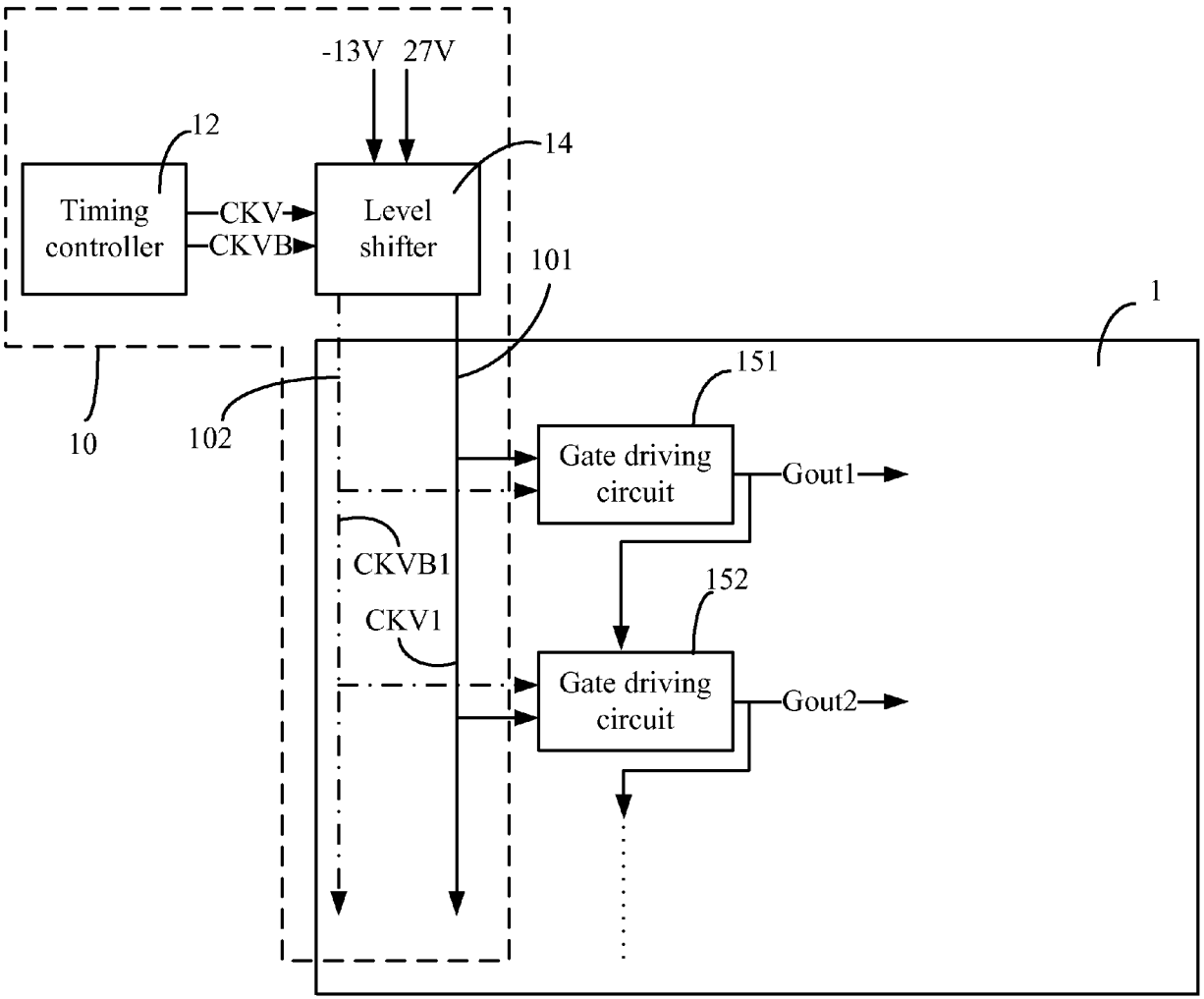
FIG. 1 (Prior Art)
FIG. 1 is a schematic diagram showing a conventional display panel driving voltage supply apparatus.
Figure 2:
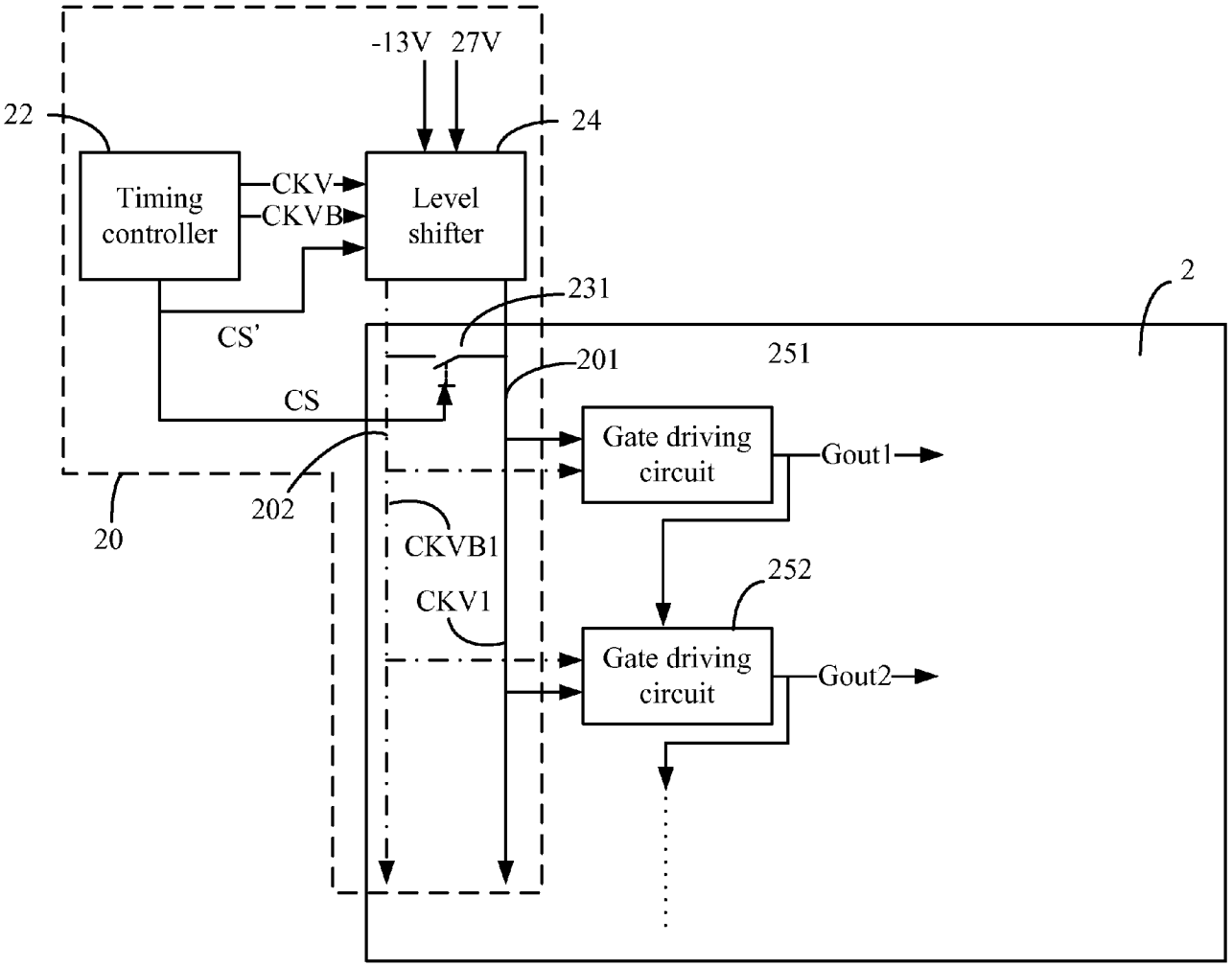
FIG. 2 is a schematic diagram showing a display panel driving voltage supply apparatus implemented according to a first embodiment of the present invention.
Figure 3:
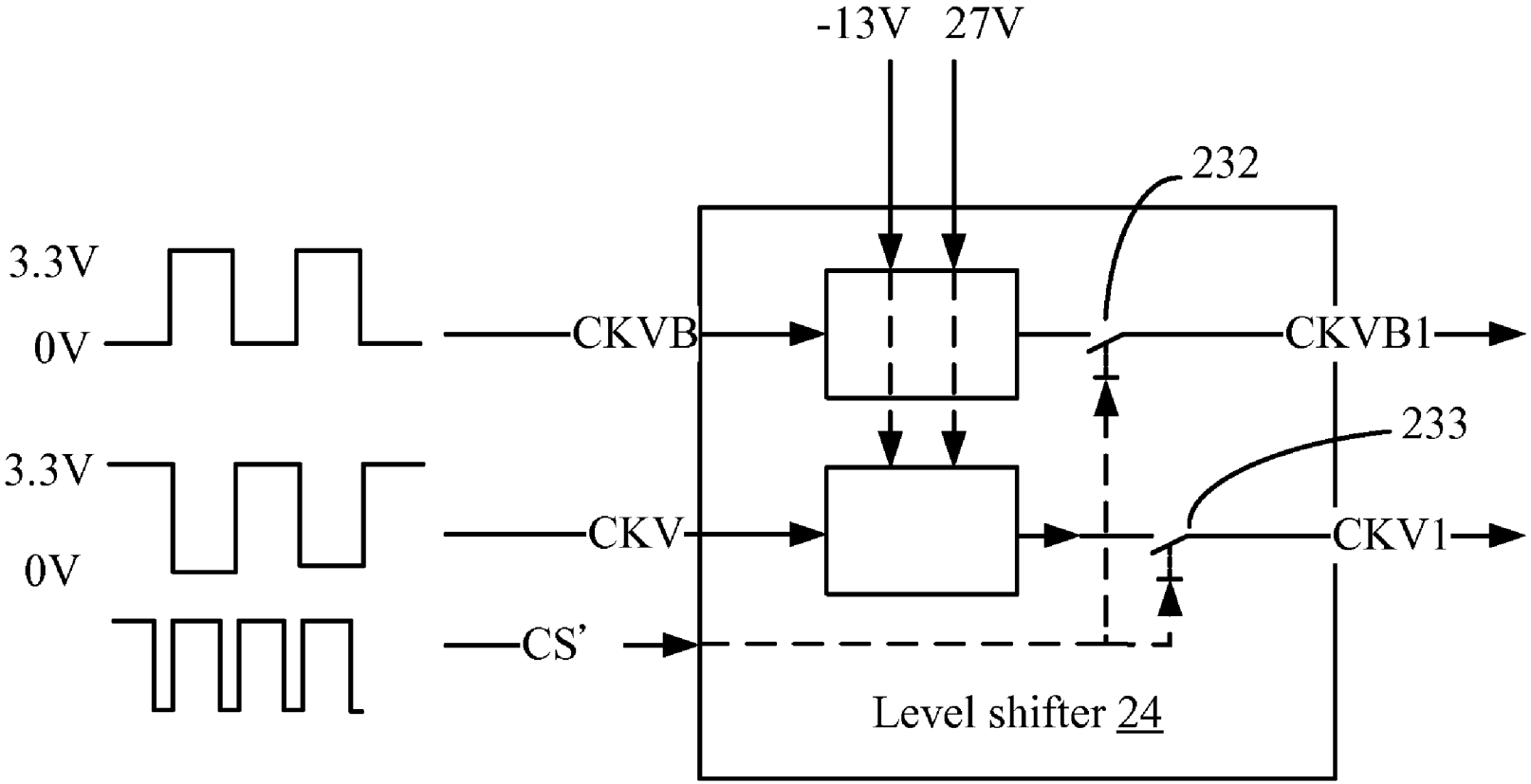
FIG. 3 is a schematic diagram showing a detailed circuit of a level shifter shown in FIG. 2.
Figure 4:
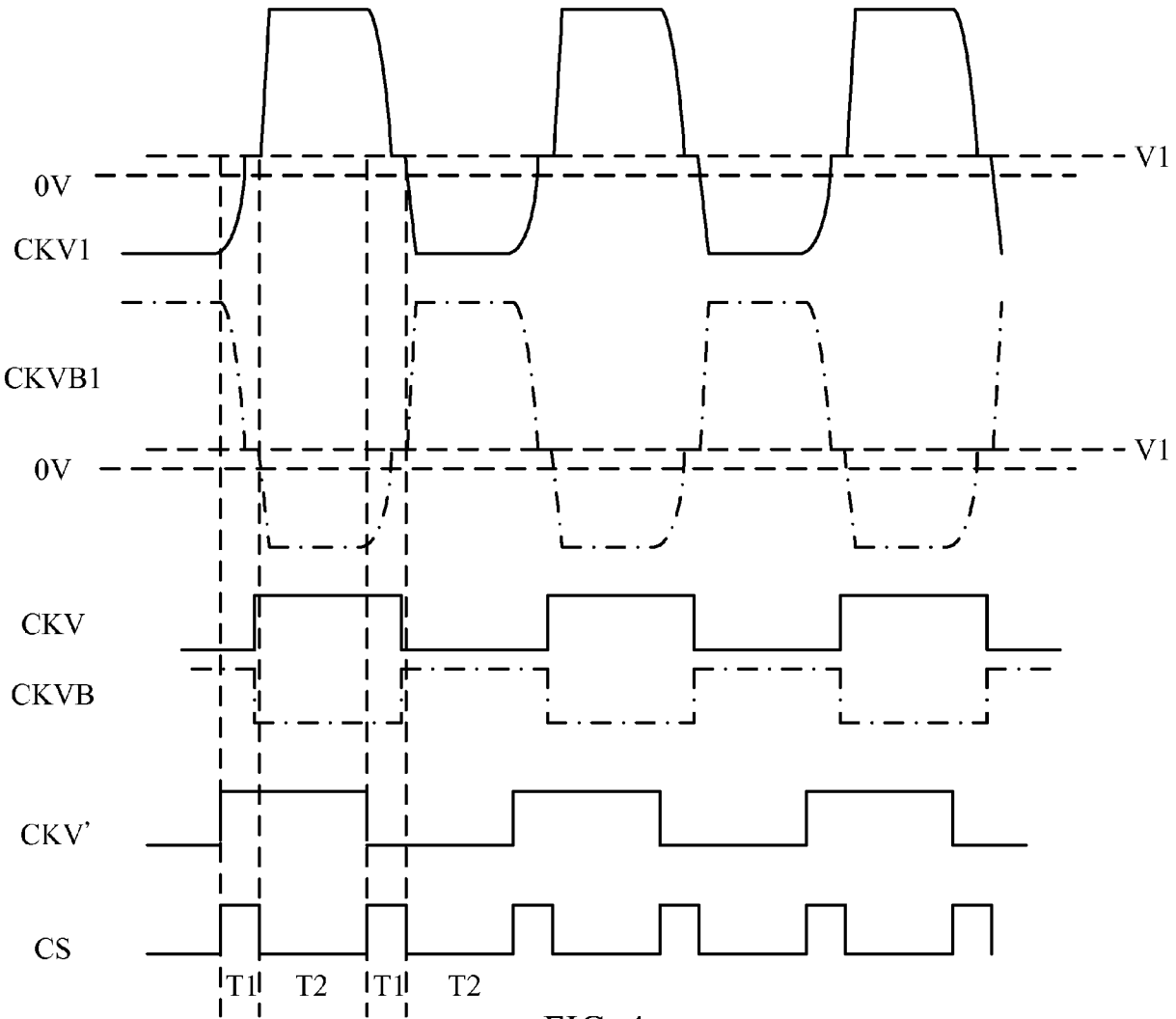
FIG. 4 is a timing chart of driving voltage of the first embodiment of the present invention.
Figure 5:
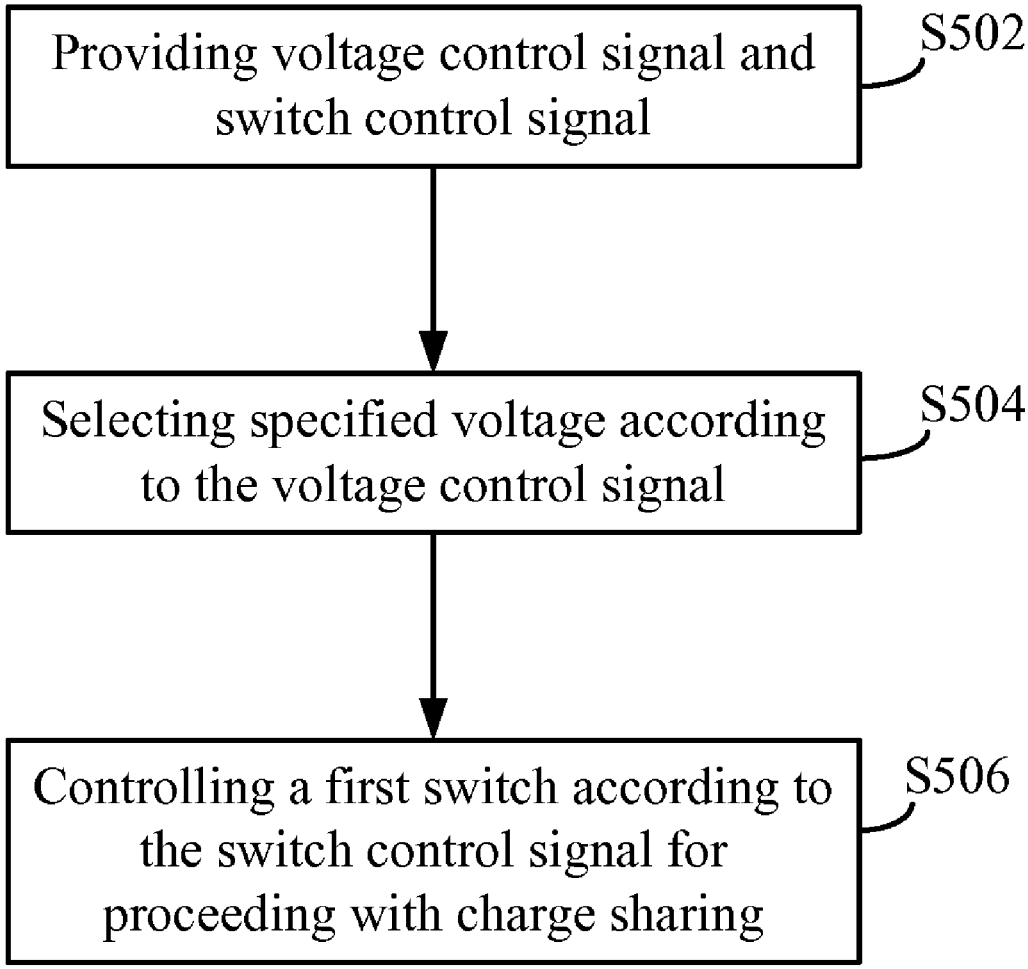
FIG. 5 is a flow chart showing a display panel driving voltage supply method implemented according to the present invention.

FIG. 2 is a schematic diagram showing a display panel driving voltage supply apparatus 20 implemented according to a first embodiment of the present invention. FIG. 3 is a schematic diagram showing a detailed circuit of a level shifter 24 shown in FIG. 2. FIG. 4 is a timing chart of driving voltage of the first embodiment of the present invention. FIG. 5 is a flow chart showing a display panel driving voltage supply method implemented according to the present invention.

Referring to FIGS. 2 and 3, a display panel 2 has a plurality of gate driving circuits such as 251, 252, disposed thereon, as shown in FIG. 2. The display panel driving voltage supply apparatus 20 comprises a timing controller (T-CON) 22, a level shifter 24, and a first driving voltage supply line 201 and a second driving voltage supply line 202 coupled to the level shifter 24. The display panel driving voltage supply apparatus 20 further comprises a first switch 231 coupled between the two driving voltage supply lines 201, 202. As shown in FIG. 3, the level shifter 24 has a second switch 232 and a third switch 233 arranged respectively corresponding to the first driving voltage supply line 201 and the second driving voltage supply line 202.

As shown in FIGS. 2 and 3, the timing controller 22 provides voltage control signals (e.g. CKV, CKVB) and switch control signals (e.g. CS, CS'). The voltage control signals CKV, CKVB, are outputted to the level shifter 24. The switch control signal CS is utilized to control the first switch 231 and the switch control signal CS' is utilized to control the second switch 232 and the third switch 233.

Referring to FIGS. 2, 3, and 4, the level shifter 24 is utilized for adjusting voltage levels according to the voltage control signals provided by the timing controller 22. Specifically, the level shifter 24 has two terminals respectively being inputted with a first specified voltage and a second specified voltage having fixed voltages, such as 27V and −13V. According to the voltage control signals CKV and CKVB provided by the timing controller 22, the level shifter 24 selects the first specified voltage to be transmitted on the first driving voltage supply line 201 and selects the second specified voltage to be transmitted on the second driving voltage supply line 202. For example, when the voltage control signals CKV, CKVB are at a high voltage level (e.g. 3.3V), the level shifter 24 selects to output the first specified voltage 27V. When the voltage control signals CKV, CKVB are at a low voltage level (e.g. 0V), the level shifter 24 selects to output the second specified voltage −13V. Moreover, when the voltage control signal CKV is at the high voltage level, the voltage control signal CKVB will be at the low voltage level. Conversely, when the voltage control signal CKV is at the low voltage level, the voltage control signal CKVB will be at the high voltage level. For example, when the voltage control signal CKV is at a level of 3.3V and the voltage control signal CKVB is at a level of 0V, the level shifter 24 will output a first voltage supply signal CKV1 with 27V corresponding to the voltage control signal CKV to be transmitted on the first driving voltage supply line 201, and output a second voltage supply signal CKVB1 with −13V corresponding to the voltage control signal CKVB to be transmitted on the second driving voltage supply line 202.

In the display panel driving voltage supply apparatus 20, the second switch 232 and the third switch 233 are operated opposite to the first switch 231. That is, when the first switch 231 is turned on, the second switch 232 and the third switch 233 will be turned off. When the first switch 231 is turned off, the second switch 232 and the third switch 233 will be turned on. The timing controller 22 provides the switch control signal CS for controlling the first switch 231 and provides the switch control signal CS' for controlling the second switch 232 and the third switch 233. The polarity of the switch control signal CS is opposite to that of the switch control signal CS'. That is, when the switch control signal CS is at a high voltage level, the switch control signal CS' will be at a low voltage level. Conversely, when the switch control signal CS is at a low voltage level, the switch control signal CS' will be at a high voltage level.

When the switch control signal CS is at the high voltage level, the first switch 231 is turned on under the control of the switch control signal CS, and thereby the first driving voltage supply line 201 and the second driving voltage supply line 202 are electrically connected. Meanwhile, the switch control signal CS' is at the low voltage level, and the second switch 232 and the third switch 233 will be turned off. Therefore, the two driving voltage supply lines 201, 202, and the level shifter 24 form an open circuit. The level shifter 24 stops transmitting the first specified voltage and the second specified voltage. In the meantime, since the voltage on the first driving voltage supply line 201 is different to that on the second driving voltage supply line 202, i.e. 27V and −13V respectively, charges of the parasitic capacitances resided in the two supply lines 201, 202, will be neutralized. That is, charge sharing is conducted between the voltages on the two supply lines when the first switch 231 is turned on. Therefore, the first voltage supply signal CKV1 on the first driving voltage supply line 201 and the second voltage supply signal CKVB1 on the second driving voltage supply line 202 will reach some particular voltage level V1, V1≈(CKV1+CKVB1)/2. That is, at the time the stage of charge sharing is finished, V1≈(27V-13V)/2, i.e., about 7V.

When the switch control signal CS is turned to the low voltage level, the first switch 231 is turned off under the control of the switch control signal CS, and thereby the electrical connection between the first driving voltage supply line 201 and the second driving voltage supply line 202 will be broken. Meanwhile, the switch control signal CS' is at the high voltage level, and the second switch 232 and the third switch 233 will be turned on. Therefore, the two driving voltage supply lines 201, 202, and the level shifter 24 form a closed circuit. The level shifter 24 starts to supply charges with the first specified voltage and the second specified voltage. In the meantime, when the level shifter 24 provides voltages to the two driving voltage supply lines 201, 202, the level shifter 24 only needs to provide an amount of charges sufficient to increase the voltage level V1 to the first specified voltage (e.g. increase the voltage from 7V to 27V) and provide an amount of charges sufficient to decrease the voltage level V1 to the second specified voltage (e.g. decrease the voltage from 7V to −13V). Compared to a circuit without charge sharing, the level shifter has to provide charges for increasing the voltage from −13V to 27V and charges for decreasing the voltage from 27V to −13V. Therefore, the present invention is capable of reducing the power consumption.

As shown in FIG. 4, the voltage variation of the first voltage supply signal CKV1 on the first driving voltage supply line 201 and the second voltage supply signal CKVB1 on the second driving voltage supply line 202, is divided into two stages, i.e. (1) charge sharing stage T1 and (2) charge supplying stage T2. During the charge sharing stage T1, the level shifter 24 stops transmitting the first specified voltage and the second specified voltage. Charge sharing is fulfilled in the time interval of T1. During the charge supplying stage T2, the level shifter 24 starts to supply the first specified voltage and the second specified voltage so as to make the first voltage supply signal CKV1 reach 27V and make the second voltage supply signal CKVB1 reach −13V, alternatively, respectively reach −13V and 27V in another period of time.

In the present invention, since charge sharing is conducted between the voltages on the two driving voltage supply lines 201, 202, the power supplied to the gate driving circuits 251, 252, can be reduced. The present invention is capable of reducing at least 50% of power consumption. Therefore, the present invention can solve the problem of high power consumption of the display panel driving voltage supply apparatus. Moreover, the present invention can reduce the working temperature of the level shifter 24, improve the stability of said electronic component, and elongate its life span as well.

In addition, as shown in FIG. 2, the first voltage supply signal CKV1 and the second voltage supply signal CKVB1 on the two driving voltage supply lines 201, 202, are provided to the respective gate driving circuits, e.g. 251, 252, so that the gate driving circuits output scan signals Gout1, Gout2, to the scan lines (or gate lines) on the display panel 2.

In addition, as shown in FIG. 4, the switch control signal CS provided by the timing controller 22 can be obtained by comparing the voltage control signals CKV, CKV'. The wave form of the signal CKV' is the same as that of the signal CKV but leading the signal CKV for an interval of time T1. The switch control signal CS is triggered at the rising edge and the falling edge of the signal CKV' and is stopped at the rising edge and the falling edge of the signal CKV. Therefore, the pulse width of the switch control signal CS is T1. It is noted that the switch control signal CS is not limited to be obtained by the aforesaid manner while other manners can be implemented as well.

In addition, the first switch can be implemented as a thin film transistor disposed on the display panel 2. The source and the drain of said thin film transistor are respectively connected to the first driving voltage supply line 201 and the second driving voltage supply line 202 and the gate of said thin film transistor receives the switch control signal CS.

Referring to FIG. 5 and accompanying with the above descriptions, a display panel driving voltage supply method in accord with the present invention comprises the following steps.

STEP S502: providing the voltage control signals CKV, CKVB, and the switch control signals CS, CS'.

STEP S504: selecting the specified voltages such as 27V, −13V according to the voltage control signals CKV, CKVB. In this step, the first specified voltage (27V) is selected to be transmitted on the first driving voltage supply line 201 and the second specified voltage (−13V) is selected to be transmitted on the second driving voltage supply line 202 according to the voltage control signals CKV and CKVB.

STEP S506: controlling the first switch 231 according to the switch control signal CS for conducting charge sharing between the first specified voltage and the second specified voltage. In this step, the first switch 231 coupled between the two driving voltage supply lines 201, 202, is controlled according to the switch control signal CS. When the first switch 231 is turned on under the control of the switch control signal CS, the first driving voltage supply line 201 and the second driving voltage supply line 202 is electrically connected with each other to charge share between the first specified voltage (27V) and the second specified voltage (−13V).

Figure 6:
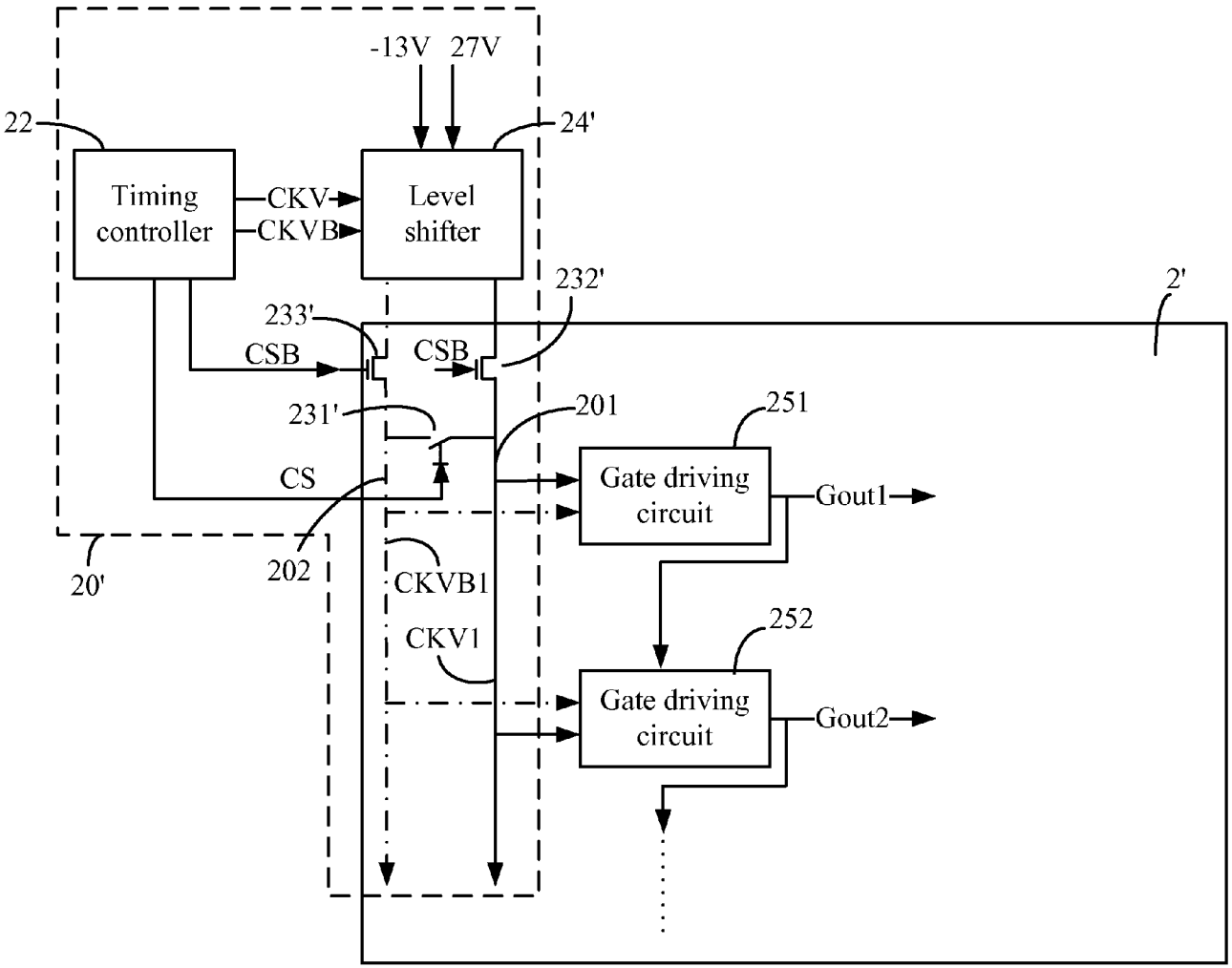
FIG. 6 is a schematic diagram showing a display panel driving voltage supply apparatus implemented according to a second embodiment of the present invention.

FIG. 6 is a schematic diagram showing a display panel driving voltage supply apparatus 20' implemented according to a second embodiment of the present invention. The difference between the first embodiment and the second embodiment of the display panel driving voltage supply apparatus 20' of the present invention is that the first switch 231', the second switch 232', and the third switch 233' of the second embodiment are all disposed on the display panel 2'. The second switch 232' is disposed on the first driving voltage supply line 201, the third switch 233' is disposed on the second driving voltage supply line 202, and the second switch 232' and the third switch 233' are respectively coupled between the first switch 231' and the level shifter 24'. The switches 231', 232', 233', can be implemented as thin film transistors. Disposing the switches 231', 232', 233', all on the display panel 2' can further reduce the cost of level shifter since it is unnecessary to customize the level shifter.

Figure 7:
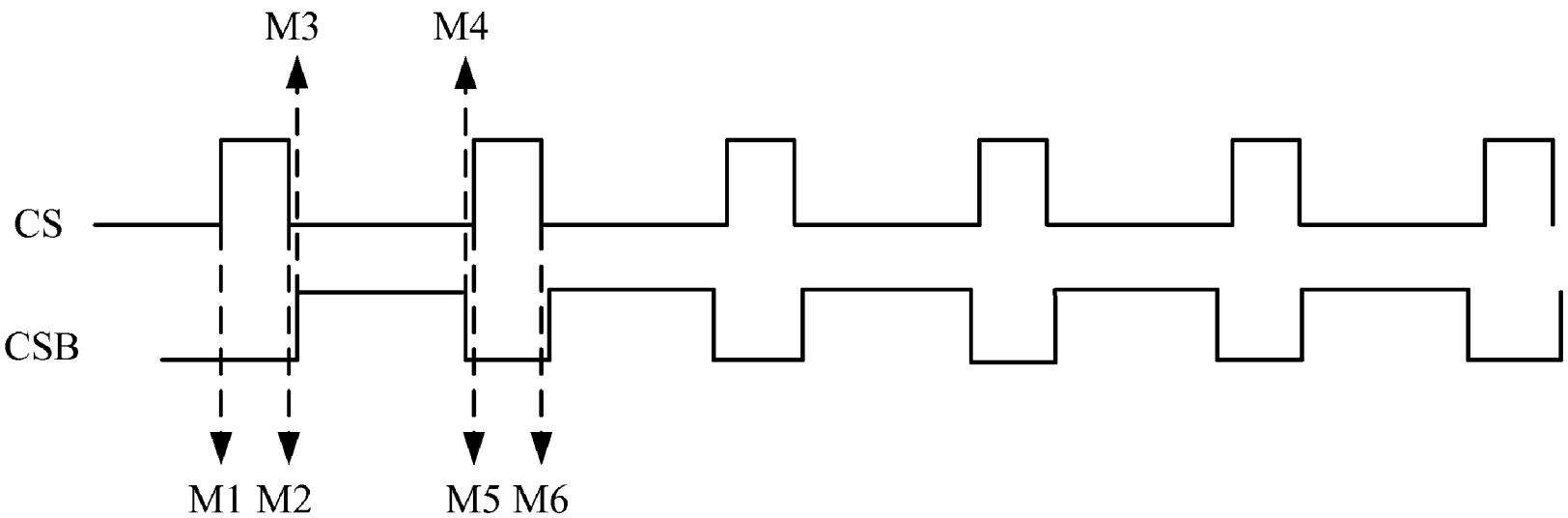
FIG. 7 is a timing chart of switch control signals provided by the timing controller.

FIG. 7 is a timing chart of switch control signals CS, CSB provided by the timing controller 22. The pulse width of low level parts of the switch control signal CSB can be wider than the pulse width of high level parts of the switch control signal CS for meeting the requirement of control timing. However, the two control signals with the same pulse width can be implemented as well.

As shown in FIG. 7, at the moment M1, the second switch 232' and the third switch 233' are turned off since the switch control signal CSB is at the low voltage level, and the first switch 231' is turned on since the switch control signal CS is at the high voltage level. At this moment, charge sharing starts to occur between the voltages on the two driving voltage supply lines 201, 202. At the moment M2, since the switch control signal CS is at the low voltage level, the first switch 231' is turned off and the charge sharing is ended for the moment. At the moment M3, the second switch 232' and the third switch 233' are turned on since the switch control signal CSB is at the high voltage level. The level shifter 24' starts to transmit the first specified voltage and the second specified voltage respectively to the first driving voltage supply line 201 and the second driving voltage supply line 202 for charging or supplying power to the display panel 2'. At the moment M4, the second switch 232' and the third voltage 233' are turned off since the switch control signal CSB is turned to the low voltage level. At this moment, the voltages on the two driving voltage supply lines 201, 202, are at a floating state. At the moment M5, the first switch 231' is turned on since the switch control signal CS is at the high voltage level. At this moment, charge sharing is started again and kept proceeding until arriving of the moment M6.

While the preferred embodiments of the present invention have been illustrated and described in detail, various modifications and alterations can be made by persons skilled in this art. The embodiment of the present invention is therefore described in an illustrative but not restrictive sense. It is intended that the present invention should not be limited to the particular forms as illustrated, and that all modifications and alterations which maintain the spirit and realm of the present invention are within the scope as defined in the appended claims.

What is claimed is:

1. A display panel driving voltage supply apparatus for providing a display panel with a driving voltage, said display panel driving voltage supply apparatus comprising:

a timing controller for providing a voltage control signal and a switch control signal;

a first driving voltage supply line;

a second driving voltage supply line;

a level shifter coupled to the first driving voltage supply line and the second driving voltage supply line respectively, the level shifter receiving the voltage control signal provided by the timing controller, and selecting a first specified voltage to be transmitted on the first driving voltage supply line as well as selecting a second specified voltage to be transmitted on the second driving voltage supply line according to the voltage control signal; and a first switch coupled between the first driving voltage supply line and the second driving voltage supply line, the first switch being controlled by the switch control signal provided by the timing controller to be turned on or off;

wherein the first driving voltage supply line and the second driving voltage supply line are electrically connected with each other to charge share between the first specified voltage and the second specified voltage when the first switch is turned on.

2. The display panel driving voltage supply apparatus according to claim 1, wherein the first specified voltage and the second specified voltage have opposite polarities.

3. The display panel driving voltage supply apparatus according to claim 1, wherein the first switch comprises a thin film transistor.

4. The display panel driving voltage supply apparatus according to claim 1, further comprising a second switch disposed on the first driving voltage supply line and a third switch disposed on the second driving voltage supply line;

wherein the second switch and the third switch are turned off when the first switch is turned on, and the second switch and the third switch are turned on when the first switch is turned off.

5. The display panel driving voltage supply apparatus according to claim 4, wherein the second switch and the third switch are disposed in the level shifter.

6. The display panel driving voltage supply apparatus according to claim 4, wherein the first switch, the second switch, and the third switch are disposed on the display panel.

* * * * *